US005080061A

United States Patent [19]

Nishimura

[11] Patent Number: 5,080,061

[45] Date of Patent: Jan. 14, 1992

[54] CONTROL APPARATUS FOR A SUCTION AIR QUANTITY OF AN ENGINE

[75] Inventor: Yukinobu Nishimura, Himeji, Japan

[73] Assignee: Mitsubishi Denki Kabushiki Kaisha, Tokyo, Japan

[21] Appl. No.: 680,976

[22] Filed: Apr. 5, 1991

[30] Foreign Application Priority Data

Apr. 26, 1990 [JP] Japan ..... 2-111118

[51] Int. Cl.[5] ..... F02D 41/16; F02M 3/06; F02M 23/06

[52] U.S. Cl. ..... 123/339; 123/479; 123/585

[58] Field of Search ..... 123/339, 479, 585, 586, 123/587, 588, 589

[56] References Cited

U.S. PATENT DOCUMENTS

| | | | |
|---|---|---|---|
| 4,006,718 | 2/1977 | Konomi | 123/479 X |
| 4,531,490 | 7/1985 | Kishi et al. | 123/479 X |
| 4,716,871 | 1/1988 | Sakamoto et al. | 123/339 |
| 4,718,016 | 1/1988 | Sudo | 123/479 X |
| 4,748,951 | 6/1988 | Manaka et al. | 123/339 |
| 4,750,460 | 6/1988 | Peter | 123/339 |
| 4,765,299 | 8/1988 | Wataya et al. | 123/479 |
| 4,877,003 | 10/1989 | Shimomura et al. | 123/339 |
| 4,884,540 | 12/1989 | Kishimoto et al. | 123/339 |
| 4,886,029 | 12/1989 | Lill et al. | 123/479 |
| 4,887,570 | 12/1989 | Meicher | 123/479 |
| 4,928,228 | 4/1990 | Fujimoto et al. | 123/479 X |

*Primary Examiner*—Willis R. Wolfe
*Attorney, Agent, or Firm*—Sughrue, Mion, Zinn, Macpeak and Seas

[57] ABSTRACT

A control apparatus for a suction air quantity of an engine adapted to detect a revolution number of the engine, to measure a difference between the detected revolution number of the engine and a target revolution number of the engine, and to regulate a suction air quantity in a bypass passage which bypasses a throttle valve of the engine corresponding with the difference so that the revolution number of the engine agrees with the target revolution number of the engine, which comprises misfire detecting means for detecting a misfire of the engine, means for outputting a first signal of correcting a timewise change of a suction quantity of the engine based on the difference between the revolution number and the target revolution number of the engine, means for retaining the first signal to a value just before the misfire in case of detecting of the misfire, and means for outputting a second signal for increasing the suction quantity so that the suction quantity is increased in case of detecting of the misfire.

1 Claim, 4 Drawing Sheets

CONTROL APPARATUS FOR A SUCTION AIR QUANTITY OF AN ENGINE

BACKGROUND OF THE INVENTION

1. Field of the Invention

The present invention relates to a control apparatus for a suction air quantity of an engine capable of controlling a suction air quantity of an engine in case of a misfire or the like.

2. Discussion of Background

A control apparatus for a suction air quantity of an engine of this kind is well known wherein the suction quantity to an engine is controlled by changing an opening area of a passage which bypasses a throttle valve. In this apparatus, especially, to stabilize a revolution number of an engine in idling time, the suction quantity of air in the bypass passage corresponding with the temperature of the engine by an open loop control. In this apparatus after detecting the throttle valve is fully closed by an idling switch and the like, the revolution number of the engine is controlled by a feed back control to a target revolution number. It is generally well known that a suction quantity control is carried out to correct timewise change by this feed back control of the revolution number.

No description has been made on the protection measure for a misfire of the engine in this conventional apparatus.

The conventional control apparatus for a suction air quantity of an engine composed as above has a problem wherein, when one cylinder of, for instance, a four cylinder engine is misfired in idling time, the revolution number of the engine rapidly drops after the misfire, and the engine may have an engine stall.

Even if the engine does not have an engine stall, the revolution number of the engine is controlled by a feed back control system with the residual three cylinders, which requires a considerable time until the revolution number of the engine reaches a predetermined revolution number, that causes the instability of the rotation of the engine during that period.

Moreover, when the revolution number of the engine reaches a predetermined quantity in misfire time, if a suction air control to correct the timewise change, so called a learning control, is carried out, and if the misfire is temporary and stops happening, the suction quantity becomes so large that the revolution number of the engine becomes higher than the predetermined revolution number.

SUMMARY OF THE INVENTION

It is an object of the present invention to provide a control apparatus for a suction air quantity of an engine capable of stabilizing the revolution number of the engine in a misfire time. According to the present invention, there is provided a control apparatus for a suction air quantity of an engine adapted to detect a revolution number of the engine, to measure a difference between the detected revolution number of the engine and a target revolution number of the engine, and to regulate a suction air quantity in a bypass passage which bypasses a throttle valve of the engine corresponding with the difference so that the revolution number of the engine agrees with the target revolution number of the engine, which comprises misfire: detecting means for detecting a misfire of the engine; means for outputting a first signal of correcting a timewise change of a suction quantity of the engine based on the difference between the revolution number and the target revolution number of the engine; means for retaining the first signal to a value just before the misfire in case of detecting of the misfire; and means for outputting a second signal for increasing the suction quantity so that the suction quantity is increased in case of detecting of the misfire.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
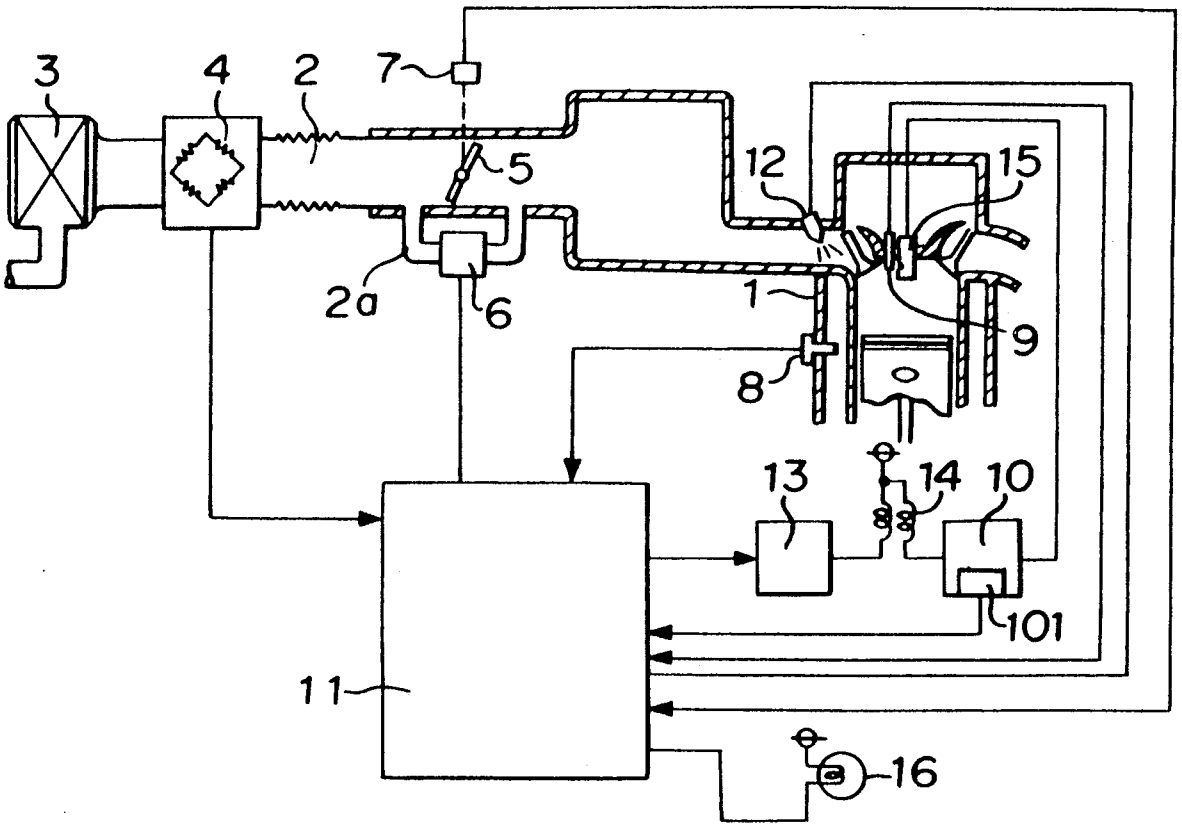
FIG. 1 is a diagram showing an embodiment of the control apparatus for a suction air quantity of an engine according to the present invention.

Referring to the drawings, an embodiment of this invention will be explained in the followings.

FIG. 1 shows a suction air quantity control device of an engine as an embodiment according to the present invention. A numeral 1 signifies an engine, to which the suction passage 2 is connected. From the upstream side of the suction passage 2, the air cleaner 3, the suction air quantity sensor and the throttle valve 5 are installed. At before and after the throttle valve 5, the bypass passage 2*a* of the suction air passage 2 is installed. At this bypass passage 2*a*, the bypass passage control mechanism 6 which is consisted of a suction air control means, or the suction air control valve (ISC valve) 61 and so on.

A numeral 7 signifies an idle switch which detects the fully closed position of the throttle valve 5. A numeral 8 signifies a temperature sensor which detects a temperature of an engine 1, that is, a cooling water temperature thereof. A numeral 9 signifies a sensor for an inner pressure of cylinder which detects an inner pressure of cylinder of the engine 1, and generates a signal corresponding to the inner pressure of cylinder.

A numeral 10 signifies a distributor which incorporates the crank angle sensor 101, by which a high electric voltage is supplied to the ignition plug 15. The crank angle sensor 101 detects a predetermined crank angle of the engine 1 and generates a revolution signal and a cylinder identifying signal.

A numeral 11 is a control device, which controls the ISC valve 61 based on the output signals from the above-mentioned elements. The control device 11 carries out a fuel control by driving the injector 12, and controls a current flowing time of the ignition coil 14 and an ignition timing by controlling the ignitor 13. The control device 11 lighten the failure display lamp 16 when a misfire of the engine 1 is detected.

Figure 2:
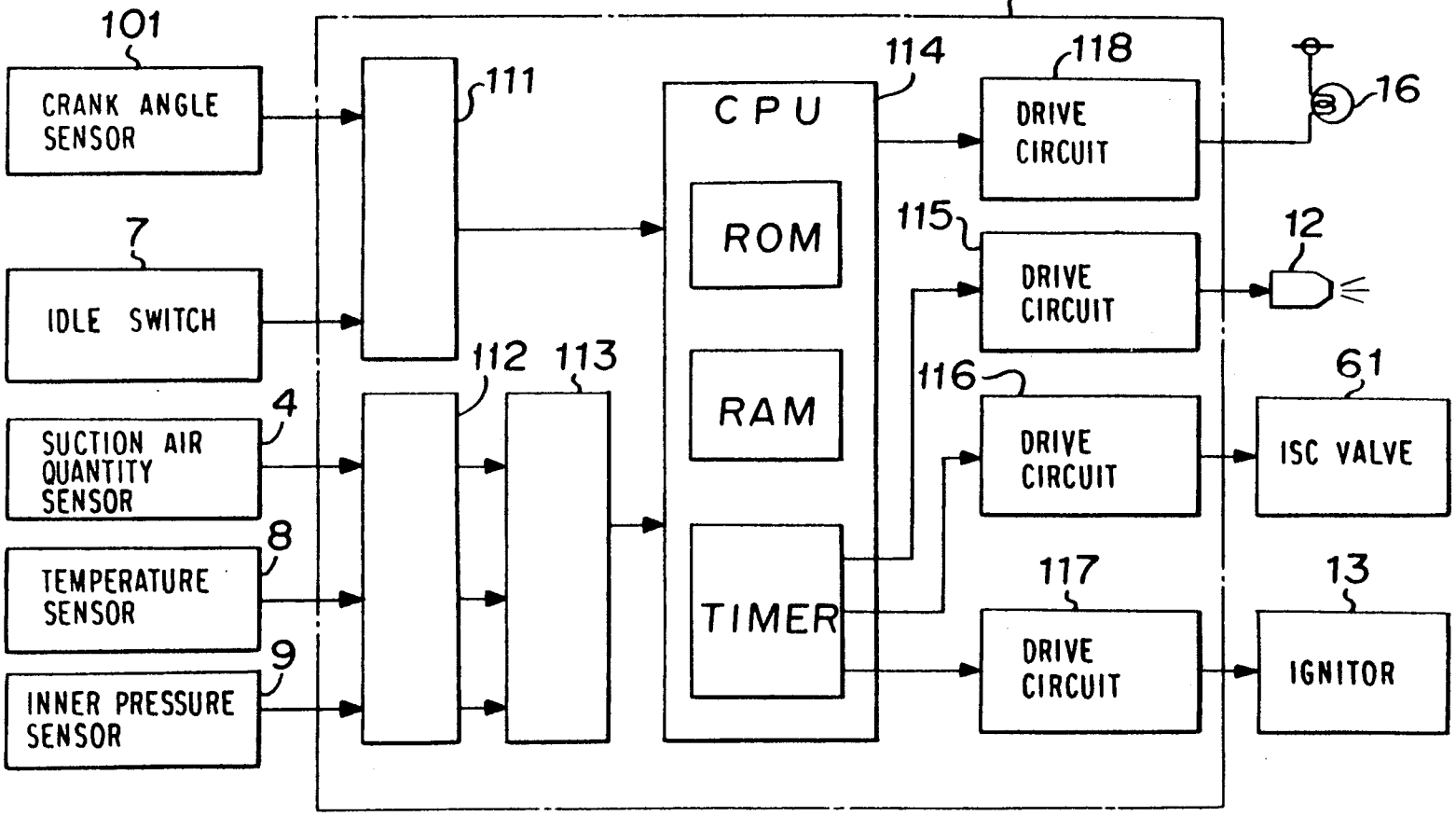
FIG. 2 is a diagram showing an inner structure of a control device shown in FIG. 1.

FIG. 2 shows the inner structure of the control device 11. The part 111 is a digital interface which receives a revolution signal and a cylinder identifying signal from the crank angle sensor 101, and a digital output of the idle switch 7, and the outputs thereof are inputted to the CPU 114. A numeral 112 signifies an analog interface which receives analog signals from the suction air quantity sensor 4, the temperature sensor 8 and the sensor for an inner pressure of cylinder 9, and the output of which is inputted to the CPU 114 via the A/D convertor 113.

The CPU 114 incorporates a RAM, a ROM, a timer and so on, based on the above inputs, and controls the injector 12, the ISC valve 61, the ignitor 13 and the failure display lamp 16, by actuating the drive circuits from 115 to 118.

In an idling time of the engine 1, the throttle valve 5 is fully closed, which is detected by the idle switch 7 that is ON. At that time, the engine 1 sucks the air which passes through the air cleaner 3, the suction passage 2 and mainly the bypass passage 2*a*. The output of the suction air quantity sensor 4 which corresponds to the suction air quantity, is read by the CPU 114 for a calculation of a fuel quantity as a digitalized value of the suction air quantity detect value $Q_e$, which is processed through the analog interface 112 and the A/D convertor 113.

An output of the temperature sensor 8 which detects the cooling water temperature of the engine 1, is read in by the CPU 114 as a temperature detect value $S_{WT}$ which is digitalized by the same route. The CPU 114 receives an idle switch signal $S_I$ which is an ON - OFF signal of the idle switch 7 from the digital interface 111, and calculates an engine revolution number $n_e$ from a signal period of the crank angle sensor 101.

Furthermore, an output of the sensor for inner pressure of cylinder 9 which detects an inner pressure of cylinder of the engine 1 is read by the CPU 114 as a digitalized value of the inner pressure of cylinder $P_{SI}$, through the analog interface 112 and the A/D convertor 113. The normal operations of an engine other than those by the CPU 114 is well known and the explanation is not made for them.

Figure 3:
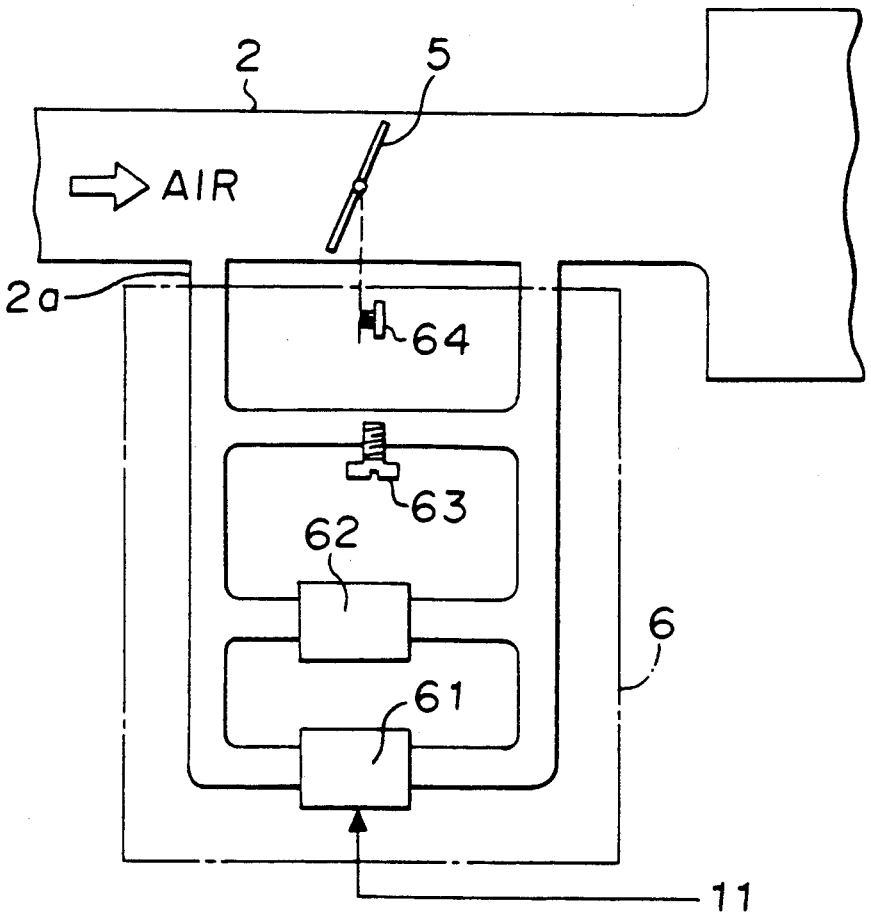
FIG. 3 is a diagram showing a detailed structure of a bypass passage control mechanism shown in FIG. 1.

FIG. 3 shows the structure of the bypass passage control mechanism 6. The ISC valves 61 is actually a linear solenoid valve which controls the suction air quantity by changing the opening area of the bypass passage 2*a* by a duty control. A numeral 62 signifies a wax-type air valve, which regulates a flow passing area by using a quality of wax whereby the state thereof changes from a solid to a liquid and vice versa. A numeral 63 signifies an air regulating screw for a regulation of the air quantity in the bypass passage 2*a*, which absorbs the initial variation. A numeral 64 signifies a regulating screw for when the throttle valve 5 is fully closed, which determines a leakage flow quantity when the throttle valve 5 is fully closed.

Figure 4:
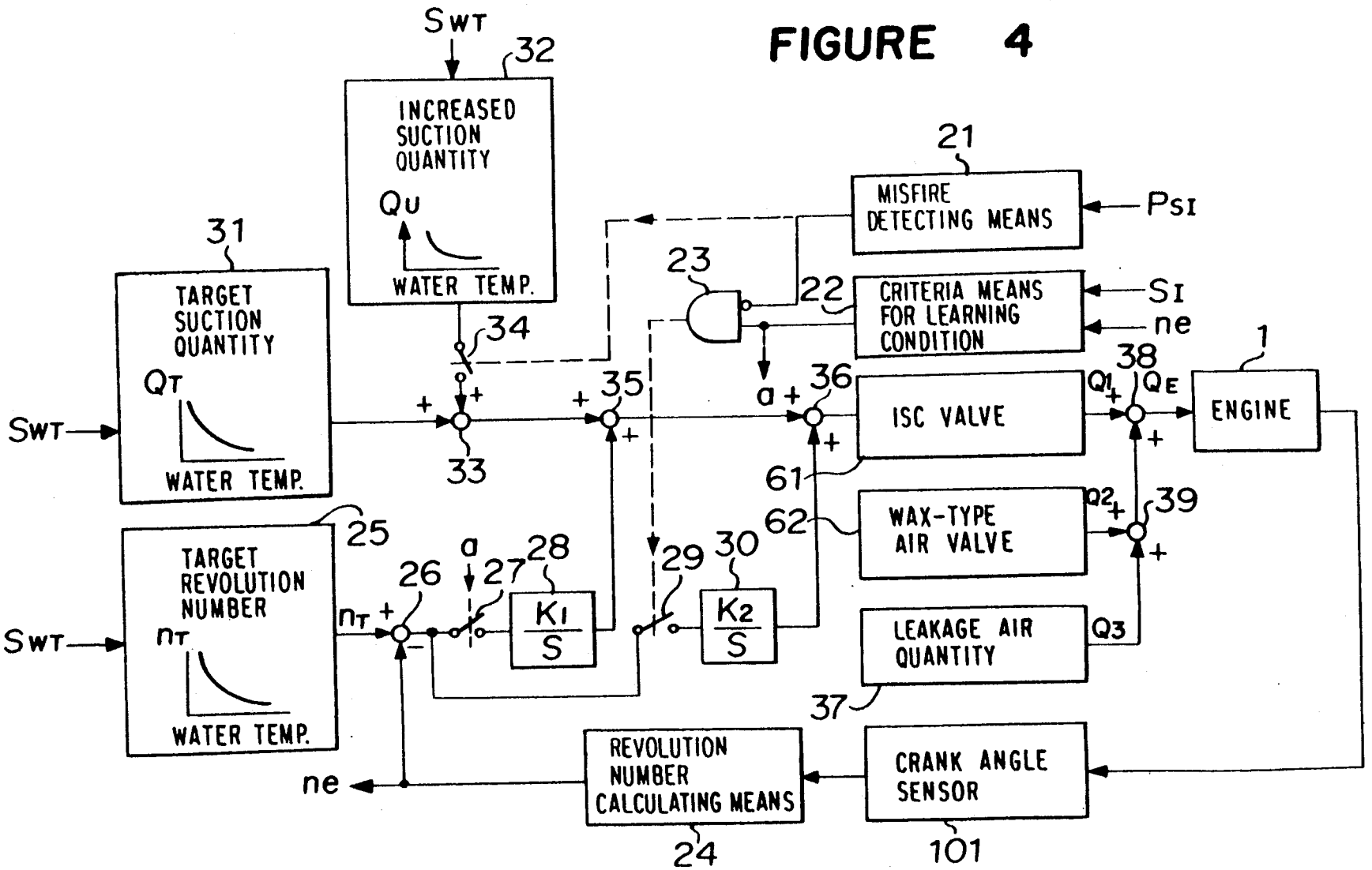
FIG. 4 is a control block diagram of an embodiment of this invention.

FIG. 4 is a control block diagram showing a suction air quantity control device of an engine as an embodiment according to the present invention. In FIG. 4, numerals 1, 61, 62 and 101 are the same parts as shown in from FIG. 1 to FIG. 3. The inner structure of the CPU 114 is shown by the elements except the route from the ISC valve 61 to the crank angle sensor 101.

A numeral 21 signifies a well known misfire detecting means which detects a misfire of the engine 1 based on for instance a value of inner pressure cylinder $P_{SI}$. A numeral 22 signifies a criteria means for learning condition which judges whether a learning condition, for instance in idling time, is established, from an idle switch signal $S_I$ and a revolution number of engine $n_e$. A numeral 23 signifies a not-one-input-type AND gate, of which negation input part is connected to an output wire of the misfire detecting means 21, and another input terminal of which is connected to an output wire of the criteria means for learning condition 22.

A numeral 24 signifies a revolution number calculating means which calculates the revolution number of engine $n_e$ based on an output of the crank angle sensor 101. A numeral 25 signifies a target revolution number output means which outputs a target revolution number $n_T$ which corresponds to a temperature detecting value $S_{WT}$. A numeral 26 signifies a deducter which calculates the difference between the target revolution number $n_T$ and the revolution number of engine $n_e$. The output side of the deducter 26 is connected to the input part of the first integrator 28, via the first switch 27, which makes ON and OFF corresponding with the output of the criteria means for learning condition 22, and also connected to the input part of the second integrator 30 near via the second switch 29 which makes ON and OFF corresponding with the outputs of the not-one-input-type AND gate.

The first integrator 28 generates a signal of a fed back correction suction quantity $Q_c$ which nullifies the difference between the target revolution number $n_T$ and the revolution number of engine $n_e$. The second integrator 30 generates a signal of the timewise change correction quantity $Q_V$. The time constant $K_2$ of the second integrator 30 is set to a considerably large value compared with the time constant $K_1$ of the first integrator 28.

A numeral 31 signifies a target suction quantity output means which generates a signal of the target suction quantity $Q_T$ which corresponds with the temperature detecting value $S_{WT}$. A numeral 32 signifies an increased suction quantity output means which generates a signal of the increased suction quantity $Q_U$ for misfire time which corresponds with the temperature detect value $S_{WT}$. A numeral 33 signifies the first adder, the input part of which is connected to the target suction quantity output means 31, and the increased suction quantity output means 32 via the third switch 34, which makes ON and OFF corresponding to the output of the misfire detecting means 21.

A numeral 35 signifies the second adder, the input part of which is connected to the first adder 33 and the first integrator 28. A numeral 36 signifies the third adder, the input part of which is connected to the second adder 35 and the second integrator 30. The output of the third adder 36 is inputted to the ISC valve 61.

Suppose that the suction air quantity which passes the ISC valve 61 is $Q_l$, the suction air quantity which passes the wax-type air valve 62 is $Q_2$ and the leakage air quantity 37 which is a sum of the leakage air quantity of the throttle valve 5 and the leakage air quantity which passes a passage of the air regulating screw 63 is $Q_3$, then the summarized suction air quantity $Q_E = Q_1 + Q_2 + Q_3$ is sucked to the engine 1.

The second switch 29 and the second integrator 30 constitute a timewise change correction means. The third switch 34 and the increased suction quantity output means 32 constitute a quantity increase means.

Next, referring to FIG. 4, the control operation of the embodiment will be given in the followings. The revolution number calculating means 24 calculates the revolution number of an engine $n_e$ based on the period of the outputs of the crank angle sensor 101 which detects a predetermined crank angle of the engine 1, and outputs it.

When the revolution number of an engine $n_e$ is under a predetermined revolution number and the idle switch signal $S_I$ is ON, the criteria means for learning condition 22 judges that the engine is in idling, generates a signal of "H" level (hereinafter "H") as the establishment of the learning condition, and in the other cases, generates a signal of "L" level (hereinafter "L"). The misfire detecting means 21 detects a detected value of the inner pressure of cylinder $P_{SI}$ which represents the inner pressure of cylinder of the engine 1 in its explosion stroke, compares the maximum value with a predetermined value, generates "H" after a judgment of a misfire when the inner pressure of cylinder is below the predetermined value, and generates "L" after a judgment of a normal condition when the inner pressure of cylinder is above the predetermined value.

In the normal condition, since the misfire detecting means 21 generates "L", the third switch 34 is OFF, and the output of the not-one-input-type AND gate 23 depends on the output of the criteria means for learning condition 22. When the engine is in idling, the output of the criteria means for learning condition 22 is "H", the first switch 27 is ON by the output, and by the output, the output of the not-one-input-type AND gate 23 is "H" which makes the second switch 29 ON.

The target revolution number output means 25 generates the target revolution number $n_T$ by the temperature detecting value $S_{WT}$ which represents the temperature of the engine 1. A difference between the target revolution number $n_T$ and the engine revolution number $n_e$ is produced at the deducter 26. This difference of revolution numbers, $n_T-n_e$ is transferred through the first switch 27 and integrated by the first integrator 28, and also integrated by the second integrator 30 after transferred through the second switch 29. The first integrator 27 generates a signal of the feed back correction suction quantity $Q_C$ so that the difference of the revolution numbers, $n_T-n_e$ converges to zero at once, and the second integrator 30 generates a signal of the timewise change correction suction quantity $Q_V$.

The target suction quantity output means 31 generates a signal of the target suction quantity $Q_T$ which corresponds with the temperature detect value $S_{WT}$. The signal $Q_T$ and the feed back correction suction quantity $Q_C$ outputted by the integrator 28 are added by the second adder 35, and the added value and the timewise change correction quantity $Q_V$ outputted by the second integrator 30 are further added by the third adder 36. Accordingly, the output of the third adder 36 is $Q_1=Q_T+Q_C+Q_V$, which is inputted to the ISC valve 61. The opening of the ISC valve 61 is controlled by this signal and the air having the air quantity $Q_I$ passes the valve 61. Suppose that the air quantity of the wax-type air valve 62 is $Q_2$, and the leakage air quantity is $Q_3$, then the air quantity of $Q_E=Q_1+Q_2+Q_3$ is sucked into the engine 1 through the junction parts 38 and 39.

When the engine is normal and not in idling, the criteria means for learning condition 22 generates "L". Therefore, the first switch 27 and the second switch 29 are OFF. The first integrator 28 and the second integrator 30 retain the output values at the time just before the first switch 27 and the second switch are switched from ON to OFF, and generate the output values.

Next, the misfire detecting means 21 generates "H" when it detects a misfire. The third switch 34 is ON by this output. Since the output of the not-one-input-type AND gate 23 becomes always "L", the second switch 29 is OFF. The first switch 27 depends on the output of the criteria means for learning condition 22. In this condition, the increased suction quantity output means 32 outputs a signal of the increased suction quantity $Q_U$ which corresponds with the temperature detect value $S_{WT}$ to the first adder 33 through the third switch 34. The signal of the increased suction quantity $Q_U$ and the signal of the target suction quantity $Q_T$ which is outputted by the target suction quantity output means 31, are added by the first adder 33. The signal of $Q_T+Q_U$ which is the output of the first adder 33 is added by the signal of the feed back correction suction quantity $Q_C$ which is the output of the first integrator 28, at the adder 35, and the sum is further added by the signal of the timewise change correction suction quantity $Q_V$ which is the output of the second integrator 30, at the third adder 36. Of course, the signal of the timewise change correction suction quantity $Q_V$, if the engine was in idling and a learning condition was established just before the misfire, is retained to the latest value just before the misfire is detected by the misfire detecting means 21 and the second switch 29 is OFF, by the second integrator 30. When the misfire is detected, the second integrator 30 stops renewing the timewise change correction suction quantity $Q_V$ for correcting the timewise change, by making the second switch 29 OFF.

The signal of the output of the third adder 36 $Q_T+Q_U+Q_C+Q_V$ is inputted to the ISC valve 61, whereby the opening of the ISC valve 61 is regulated and the air quantity of $Q_1=Q_T+Q_U+Q_C+Q_V$ passes through the valve. In addition to the air quantity $Q_1$, the engine 1 sucks the air having the air quantity $Q_2$ for passing through the wax-type air valve 62 and the leakage air quantity $Q_3$. In this case, since the air quantity is increased by the mount of $Q_U$ of the increased suction quantity, the lowering of the revolution number of the engine 1 by the misfire is corrected and the revolution number of the engine recovers, at once, to the value before the misfire. Furthermore, even if the misfire is temporary, since the second integrator 30 retains the latest output value just before the misfire, the same control as before the misfire is carried out when the misfire is eliminated, which prevents the excessive increase of the revolution number of the engine.

In the above embodiment, the renewal of the timewise change correction value which is the output of the second integrator 30, is stopped when a misfire happens. It is possible to install a fourth switch which is similar to the second switch 29, between the second integrator 30 and the third adder 36, and make the fourth switch OFF when a misfire happens, which prohibits the timewise change correction control.

In the above embodiment, the increased suction quantity $Q_U$ is a function of the temperature detecting value $S_{WT}$. However, the increased suction quantity $Q_U$ can be a predetermined value.

As mentioned above, according to this invention the suction quantity of an engine is increased and the renewal of the timewise change correction suction quantity based on a feed back control by the revolution number of the engine is stopped when a misfire happens. Accordingly, the lowing of the torque of the engine by the misfire can be compensated by increasing the generated torque of the other cylinders which are running normally, which enables the prevention of a stall of the engine at the misfire. Moreover the influence of the increase of the suction quantity at the misfire, on the correction quantity of the timewise change correction control can be eliminated and no bad influence remains after the cause of the misfire is removed.

Obviously, numerous modifications and variations of the present invention are possible in light of the above teachings. It is therefore to be understood that within the scope of the appended claims, the invention may be practiced otherwise than as specifically described herein.

What is claimed is:

1. A control apparatus for a suction air quantity of an engine adapted to detect a revolution number of the engine, to measure a difference between the detected revolution number of the engine and a target revolution number of the engine, and to regulate a suction air quantity in a bypass passage which bypasses a throttle valve of the engine corresponding with the difference so that the revolution number of the engine agrees with the target revolution number of the engine, which comprises:

misfire detecting means for detecting a misfire of the engine;

means for outputting a first signal of correcting a timewise change of a suction quantity of the engine based on the difference between the revolution number and the target revolution number of the engine;

means for retaining the first signal to a value just before the misfire in case of detecting of the misfire; and means for outputting a second signal for increasing the suction quantity so that the suction quantity is increased in case of detecting of the misfire.

* * * * *